US009739118B2

(12) United States Patent
Halfmann et al.

(10) Patent No.: US 9,739,118 B2
(45) **Date of Patent: *Aug. 22, 2017**

(54) COMPENSATING PRESSURE CHAMBER FOR SETTING IN LOW AND HIGH HYDROSTATIC PRESSURE APPLICATIONS

(71) Applicant: BAKER HUGHES INCORPORATED, Houston, TX (US)

(72) Inventors: Eric Halfmann, Magnolia, TX (US); Daniel C. Ewing, Katy, TX (US); Bryan T. Storey, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 300 days.

This patent is subject to a terminal disclaimer.

(21) Appl. No.: 14/518,509

(22) Filed: Oct. 20, 2014

(65) Prior Publication Data

US 2016/0108700 A1 Apr. 21, 2016

(51) Int. Cl.

| | |
|---|---|
| ***E21B 34/14*** | (2006.01) |
| ***E21B 23/04*** | (2006.01) |
| ***E21B 23/06*** | (2006.01) |
| *E21B 34/00* | (2006.01) |

(52) U.S. Cl.

CPC ..... *E21B 34/14* (2013.01); *E21B 23/04* (2013.01); *E21B 23/06* (2013.01); *E21B 2034/002* (2013.01)

(58) Field of Classification Search

CPC ..... E21B 23/04; E21B 23/06

See application file for complete search history.

(56) References Cited

U.S. PATENT DOCUMENTS

| | | | | |
|---|---|---|---|---|
| 5,893,413 | A | 4/1999 | Lembcke et al. | |
| 7,891,434 | B2 | 2/2011 | Gaudette et al. | |
| 8,210,267 | B2 | 7/2012 | Avant | |
| 2004/0129423 | A1* | 7/2004 | Eddison | E21B 21/103 166/321 |
| 2006/0169462 | A1* | 8/2006 | Bishop | E21B 23/00 166/383 |
| 2009/0229832 | A1 | 9/2009 | King | |
| 2010/0147538 | A1* | 6/2010 | Gaudette | E21B 23/06 166/387 |
| 2013/0068476 | A1* | 3/2013 | Edwards | E21B 34/102 166/373 |
| 2013/0292137 | A1 | 11/2013 | Lauderdale | |

* cited by examiner

*Primary Examiner* — George Gray

(74) *Attorney, Agent, or Firm* — Mossman, Kumar & Tyler, PC

(57) ABSTRACT

A setting tool for actuating a well tool within a wellbore includes a sleeve telescopically engaging a mandreland a floating piston disposed between the sleeve and the mandrel. The floating piston has a first face subjected to a downhole hydrostatic pressure. The setting tool also includes a pressure chamber formed between the floating piston and the valve, a working fluid in the pressure chamber, and a fluid-tight collapse chamber formed between the valve and a sealed end of the sleeve. The valve selectively the working fluid from the pressure chamber into the collapse chamber if the working fluid reaches a predetermined primary pressure setting of the valve. The setting tool is connected to and actuated a consumer.

19 Claims, 3 Drawing Sheets

COMPENSATING PRESSURE CHAMBER FOR SETTING IN LOW AND HIGH HYDROSTATIC PRESSURE APPLICATIONS

CROSS-REFERENCE TO RELATED APPLICATIONS

None.

BACKGROUND OF THE DISCLOSURE

1. Field of the Disclosure

This disclosure relates generally to oilfield downhole tools and more particularly to methods and devices for hydrostatically setting a downhole tool.

2. Description of the Related Art

As the oil and gas industry continues to explore and produce from wells that are deeper and have higher hydrostatic pressures, designing downhole tools that can operate in high temperatures and high hydrostatics becomes a challenge. Hydrostatically setting a tool in a high hydrostatic environment can be difficult due to the strength limitations of tools. Low hydrostatic pressures can also introduce challenges since there is limited pressure and piston area for generating setting force. In some aspects, the present disclosure is directed to methods and devices for hydrostatically setting a downhole tool in low and high hydrostatic pressures.

SUMMARY OF THE DISCLOSURE

In one aspect, the present disclosure provides an apparatus for performing a downhole operation. The apparatus may include a mandrel, a sleeve telescopically engaging the mandrel, and a floating piston disposed between the sleeve and the mandrel, the floating piston having a first face subjected to a downhole hydrostatic pressure. The apparatus may also have a valve positioned between the sleeve and the mandrel, a pressure chamber formed between the floating piston and the valve, a working fluid in the pressure chamber and a fluid-tight collapse chamber formed between the valve and a sealed end of the sleeve, where the valve is configured to flow the working fluid from the pressure chamber into the collapse chamber if the working fluid reaches a predetermined primary pressure setting of the valve.

In another aspect, the present disclosure provides a method of actuating a well tool within a wellbore. The method may include connecting a consumer to a setting tool that has a mandrel, a sleeve telescopically engaging the mandrel, a floating piston disposed between the sleeve and the mandrel, where the floating piston having a first face subjected to a downhole hydrostatic pressure, a valve positioned between the sleeve and the mandrel, a pressure chamber formed between the floating piston and the valve, a working fluid in the pressure chamber, and a fluid-tight collapse chamber formed between the valve and a sealed end of the sleeve, where the valve is configured to flow the working fluid from the pressure chamber into the collapse chamber if the working fluid reaches a predetermined primary pressure setting of the valve. The method may also include actuating the setting tool to set the consumer.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to apparatuses and methods for setting a downhole tool in low and/or high subterranean hydrostatics. As used herein, 'hydrostatics' refers to the hydrostatic pressure of the fluid resident in a wellbore. Illustrative tools provide an "onboard" pressure source that provides the required pressure and piston area for generating a setting force for low hydrostatic applications. In addition, at high hydrostatics, the "onboard" pressure source acts as a pressure compensator that helps resist collapse or premature actuation of a pressure chamber. Thus, tools according to the present disclosure overcome the challenges of high and low hydrostatics without a need of multiple tools that target different pressure ranges using different technologies. That is, the current disclosure provides a single design solution for a wide range of hydrostatic pressures and which is adaptable to changing well conditions.

Figure 1A:
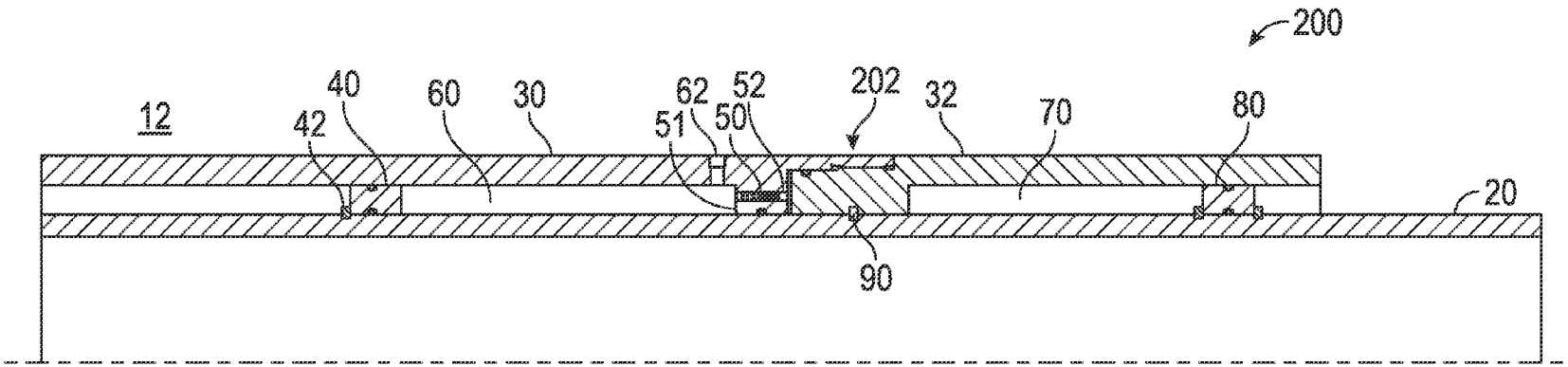
FIG. 1A shows an exemplary compensating pressure chamber in a run-in position according to the present disclosure.

FIG. 1A shows one non-limiting embodiment of a setting tool 200 according to the present disclosure. The setting tool 200 includes a sleeve assembly 202 that is disposed around a mandrel 20. The sleeve assembly 202 may include a pressure sleeve 30 that is connected a collapse chamber sleeve 32 by threads or other known connection mechanism. The setting tool 200 also includes a pressure chamber 60 that is separated from a collapse chamber 70 by a wall 51 of the sleeve assembly 202. A pressure relief valve 50 is positioned in an opening 52 of the wall 51. A floating piston 40 seals the distal end of the pressure chamber 60, and a fixed piston 80 seals the distal end of the collapse chamber 70. Initially, the pressure chamber 60 is charged with a high-pressure working fluid. The pressure chamber 60 can be filled with a fluid such as nitrogen gas, some other gas, water and/or oil through a port 62 on the pressure sleeve 30 to a charge pressure and be plugged.

In embodiments, the pressurized fluid chamber 60 is used as a pressure source to set tools downhole at low hydrostatic pressures and as a pressure compensator when high hydrostatic pressure could damage the setting tool 200. For example, the pressurized chamber 60 provides a setting energy during low hydrostatic conditions while providing a reservoir of pressure compensating fluid during high hydrostatic conditions. The fluid may be selectively communicated from the pressurized chamber to a collapse chamber to keep the external pressure differential, the collapse pressure, below values that would crush or otherwise damage the setting tool 200. In addition, the fluid may selectively prevent the sleeve assembly 202 from elastic collapse. As used herein, the term selective means that a tool or device is configured to behave in a specific manner when subjected to a predetermined condition. Illustrative setting tools are described below.

FIG. 1A shows the setting tool 200 in a run-in position. In one embodiment, the collapse chamber sleeve 32 is connected to a mandrel 20 by a locking mechanism 90. The locking mechanism 90 may be a shear pin, a shear screw, a shear ring, a key, or dogs. Therefore, during run-in, the pressure sleeve 30 is stationary with respect to the mandrel 20.

The floating piston 40 is configured to transfer a relatively high ambient pressure to the working fluid in the pressure chamber 60. In one embodiment, the floating piston 40 is stopped from axial movement away from the wall 51 by a retaining ring 42. An exterior front face of the floating piston 40 is exposed to the downhole hydrostatic pressure. An interior face of the floating piston 40 is exposed to the pressure of the working fluid in the pressure chamber 60. The floating piston 40 moves or "floats" depending on the prevailing hydrostatic pressure. If the hydrostatic pressure is greater than the working fluid pressure, the floating piston 40 moves toward the wall 51. If the hydrostatic pressure is less than the working fluid pressure, the floating piston 40 seats against the retaining ring 42.

The collapse chamber 70 may be at a pressure, such as atmospheric pressure or a lower or higher pressure, which allows either the working fluid or the hydrostatic pressure to axially displace the sleeve assembly 202. The collapse chamber 70 may be filled with a fluid such as air, nitrogen or other fluid at atmospheric pressure. The fixed piston 80, which seals one side of the collapse chamber 70, is axially constrained with respect to the mandrel 20 by retainer rings on both sides of the fixed piston 80. Optionally, some other fixing mechanism may be used with or instead of the retainer rings.

The pressure relief valve 50 allows the working fluid in the pressure chamber 60 to flow into the collapse chamber 70 when the hydrostatic pressure reaches a predetermined value. One port of the pressure relief valve 50 is connected to the pressure chamber 60 and the other port is connected to the collapse chamber 70. The pressure relief valve 50 may be an adjustable flow control device that can be set to permit fluid communication between the chambers 60 and 70 under specified conditions. In one embodiment, the pressure relief valve 50 has a single pressure setting. When the pressure in the pressure chamber 70 reaches this pressure setting, working fluid flows from the pressure chamber 60 to the collapse chamber 70. In another embodiment, the pressure relief valve 50 has a first setting to open communication and a second setting to close communication between the pressure chamber 60 and the collapse chamber 70. Thus, fluid communication is only permitted when the pressure in the pressure chamber 60 is in a range defined by the first pressure setting and the second pressure setting.

Illustrative methods for using the setting tool 200 to actuate a consumer 100 (FIGS. 3A-B) will be discussed with reference to FIGS. 1B, 2A-B, and 3A-B.

Figure 1B:
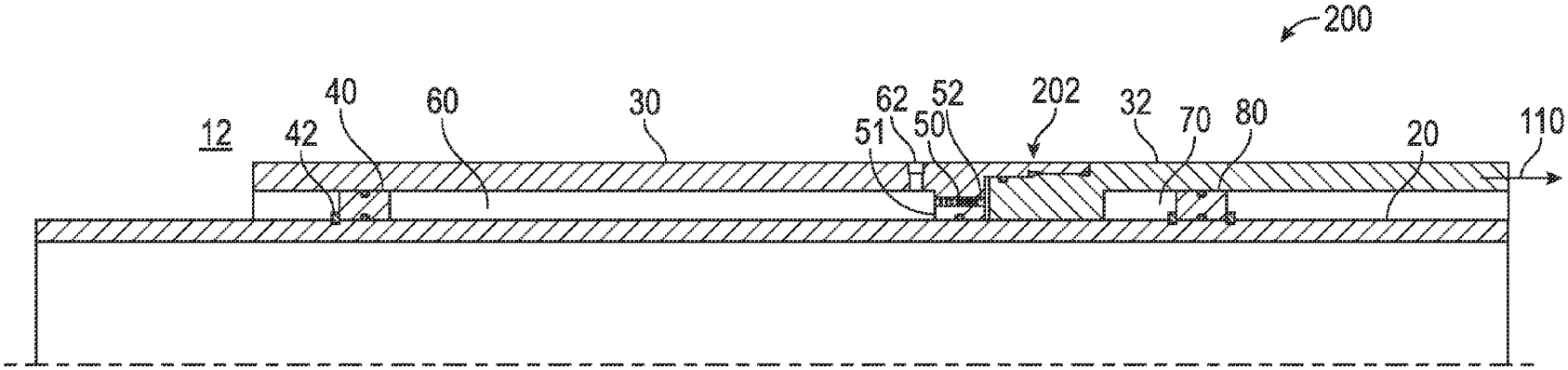
FIG. 1B shows an exemplary compensating pressure chamber in a set position in low hydrostatics.

FIGS. 1A-B show how the setting tool 200 may be actuated by primarily the working fluid when a relatively low downhole hydrostatic pressure exists. In some embodiments, a downhole hydrostatic is considered "low" if it is below the charge pressure of the working fluid. Specifically, in low downhole hydrostatic pressure, the charge pressure of the pressure chamber 60 at the target subterranean depth exceeds the downhole annulus pressure. Therefore, the pressurized working fluid pushes the floating piston 40 outward and keeps the floating piston 40 in contact with the retaining ring 42. At the same time, the pressurized working fluid pushes the sleeve assembly 200 toward a setting direction 110. However, the sleeve assembly 200 stays fixed with respect to the mandrel 20 due to the locking mechanism 90.

Referring to FIG. 1B, after the locking mechanism 90 is unlocked (e.g., sheared), the sleeves 30, 32 are free to move in the setting direction 110. The locking mechanism 90 may be a shear pin, a shear screw, a shear ring, a key, dogs, and/or an electronic-trigger system. The movement of the sleeves 30, 32 is due to the difference between the charge pressure in the pressure chamber 60 and the pressure of the collapse chamber 70. As used herein, this pressure difference will be referred to as the stroke pressure. The stroke pressure generated by the working fluid pushes the sleeve assembly 202 in the setting direction 110. During this time, the working fluid remains sealed because the first setting of the valve 50 has not been reached. The sleeve assembly 202 can stroke all the way until an end of the sleeve 32 shoulders at the fixed piston 80 or may stroke less than a full length necessary to actuate the consumer 100. In either case, the setting tool 200 can generate the required setting force independent of the low downhole hydrostatics, which can vary from zero pounds per square inch (psi) up to the charge pressure. The post-stroke pressure of the pressurized working fluid can be designed to be more than a required setting pressure to set a consumer 100.

Figure 2A:
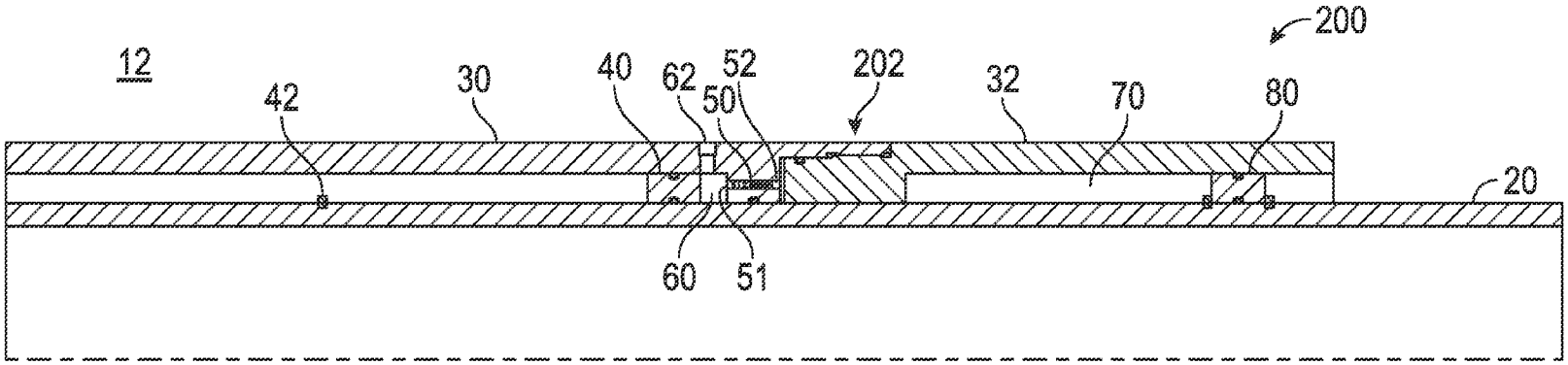
FIG. 2A shows an exemplary compensating pressure chamber in a run-in position in high hydrostatics.
Figure 2B:
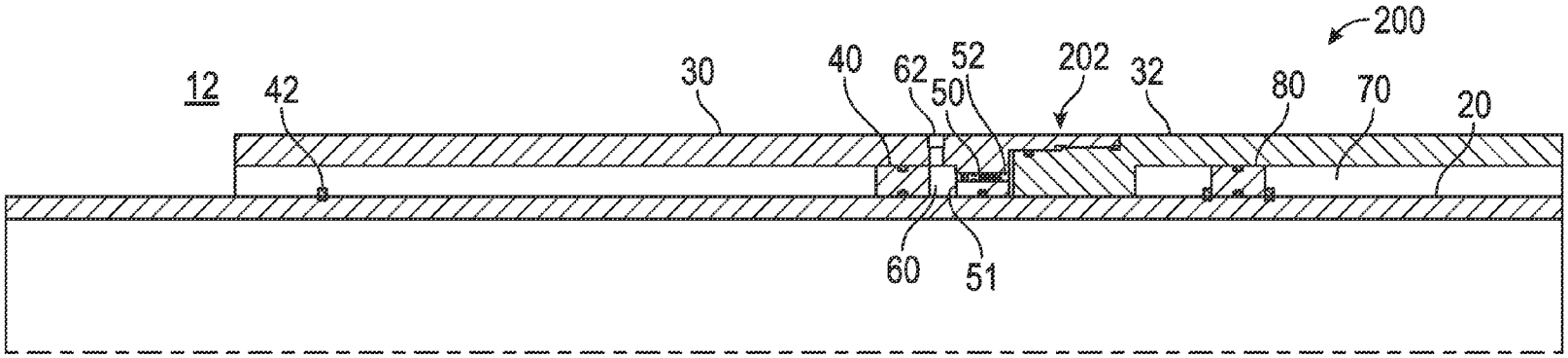
FIG. 2B shows an exemplary compensating pressure chamber in a set position in high hydrostatics.

FIGS. 2A-B show how the working fluid acts as a pressure compensator when the setting tool 200 is operated in wellbore where a relatively high downhole hydrostatic pressure exists. FIGS. 2A-B show the setting tool 200 in run-in position and set position, respectively. Referring to FIG. 2A, in high downhole hydrostatics, the annulus pressure exceeds the charge pressure and the atmospheric pressure in collapse chamber 70. The differential pressure across the collapse chamber sleeve 32, between the annulus 12 and the collapse chamber 70, is the collapse pressure. The collapse pressure tries to crush the collapse chamber sleeve 32 elastically or plastically. Alternatively, the mandrel 20 may also be susceptible to crush due to pressure differential between a flow bore inside the mandrel 20 and the chamber 70. Advantageously, the working fluid may be used to mitigate this undesirable pressure condition. As described below, the selective flow of the pressurized working fluid into the collapse chamber 70 keeps the collapse pressure below the external pressure rating of the collapse chamber sleeve 32 or the mandrel 20.

When the ambient hydrostatic pressure exceeds the pressure of the working fluid, the floating piston 40 moves towards direction 110, compresses the working fluid, and equalizes the pressure of the pressure chamber 60 and the annulus pressure 12. When the stroke pressure across the pressure relief valve 50 approaches or exceeds the first setting, the valve 50 opens and the pressurized working fluid flows into the collapse chamber 70.

As the pressurized working fluid flows through the valve 50, the pressure of the pressure chamber 60 decreases and the pressure in the collapse chamber 70 increases. Thus, the collapse pressure imposed on the structures making up the collapse chamber 70 is kept below the external pressure rating. The floating piston 40 keeps the pressure chamber 60 equalized with the hydrostatic pressure by compressing the pressurized working fluid in the pressure chamber 60. By increasing the pressure in the collapse chamber 70 by using the working fluid, the risk of crushing the pressure chamber sleeve 30 is mitigated. In effect, the collapse pressure across the collapse chamber sleeve 32 is dynamically compensated, and the setting tool 200 can be run deeper in high downhole hydrostatics.

In some embodiments, the pressure relief valve 50 may close once the pressure of the collapse chamber 70 increases enough to drop the stroke pressure across the pressure relief valve 50 to the second setting. The first setting may be higher than the second setting. In another embodiment, the pressure relief valve 50 need not be opened if the stroke pressure does not reach or exceed the first setting. In that case, the floating piston 40 still shifts and the stroke pressure shifts the sleeve assembly 202.

FIG. 2B depicts the setting tool 200 in the set position in high hydrostatics. Once the setting tool is positioned at the target depth, the pressure of the pressure chamber 60 has equalized with the pressure of the annulus 12, and the stroke pressure is the difference between the pressure of the annulus 12 and the pressure of the collapse chamber 70. When the locking mechanism 90 is released, the sleeve assembly 202 strokes due to the stroke pressure. The stroke of the sleeve assembly 202 compresses the fluid in the collapse chamber 70. Also, the floating piston 40 chases the pressure sleeve 30 to keep the fluid in the pressure chamber 60 equalized with the pressure of the annulus 12.

As the stroke decreases the volume of the collapse chamber 70, the pressure of the collapse chamber 70 increases. Therefore, the stroke pressure is reduced. Towards the end of the stroke, the pressure in the collapse chamber 70 is designed to be small enough to allow enough stroke pressure to provide the necessary setting force. Optionally, the chambers 60, 70 may be stacked in series to reach the setting force. Accordingly, multiple pressure chamber 60 and collapse chamber 70 combinations may push the sleeve assembly 202.

Figure 3A:
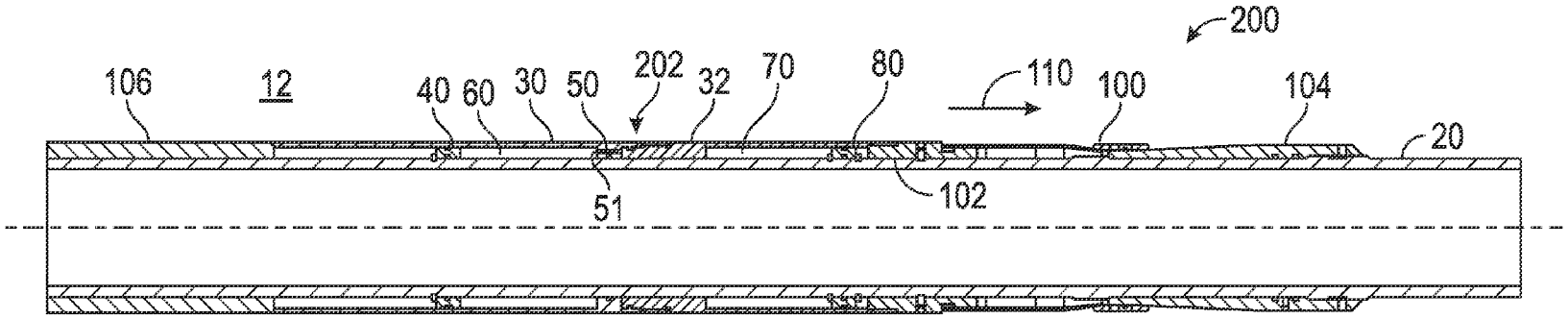
FIG. 3A shows an exemplary compensating pressure chamber with an exemplary consumer in a run-in position.
Figure 3B:
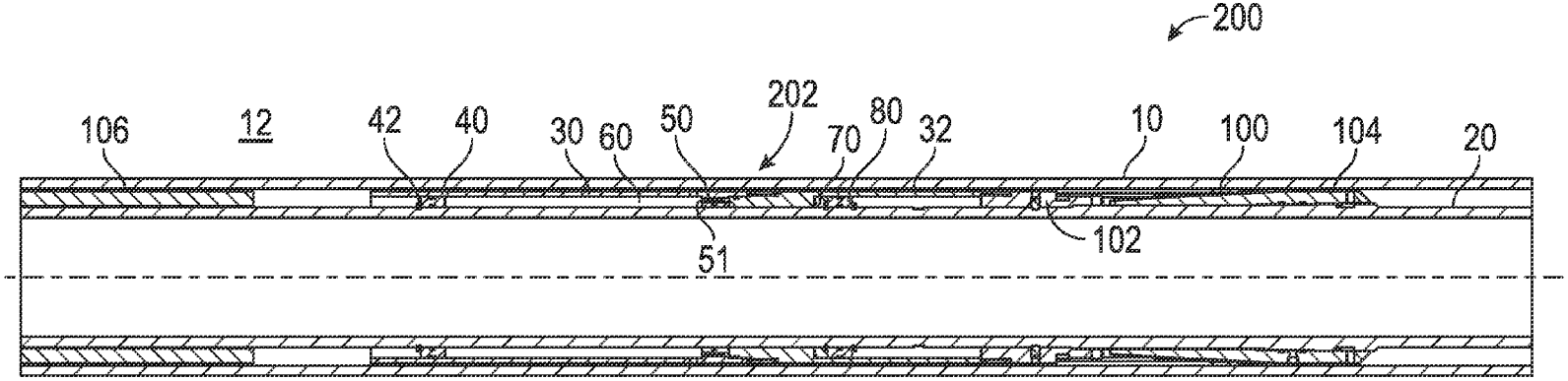
FIG. 3B shows an exemplary compensating pressure chamber with an exemplary consumer in a set position.

FIGS. 3A-B show the sleeves 30, 32 exerting a setting force on a consumer 100. A consumer 100 may be a packing element, a liner hanger, a slip assembly, a cone, and/or an expandable. In FIG. 3A, the setting tool is in the run-in position and the locking mechanism 90 is not released. FIG. 3B shows the setting tool in set position as sleeves 30, 32 stroked in low hydrostatics in casing 10. Therefore, the consumer 100 is extended radially out. Similarly, in high hydrostatics, the sleeves 30, 32 stroke pushing the consumer 100 radially outward.

It should be understood that the teachings of the present disclosure are susceptible to numerous variants. Certain non-limiting variations are described below.

In an embodiment, an intermediate member 102 may be disposed between the sleeves 30, 32 and the consumer 100. Alternatively, the sleeves 30, 32 may stroke in uphole or downhole direction depending on the axial positioning of the consumer 100 with respect to the setting tool and the need to push or pull the consumer 100.

Also, in some embodiments, the mandrel 20, instead of the sleeves 30, 32 may stroke and push the consumer 100. In that case, pistons 40, 80 may be constrained with respect to the sleeves 30, 32. In another embodiment, the sleeves 30, 32 may be manufactured as a single piece. Or, the sleeve assembly 202 or mandrel 20 may include additional sleeves, mandrels or parts. Alternatively, the fixed piston 80 may be manufactured as fixed to the collapse chamber sleeve 32. Optionally, the pressure relief valve 50 may be located in the mandrel 20 or some other member between the chambers 60, 70. In the alternative, multiple pressure relief valves 50 may be disposed in the setting tool 200 for contingency or increased stroke force.

The pressure relief valve 50 may also be a check valve, a diaphragm, a rupture disc, an electrically actuated valve, a magnetically activated valve, a poppet valve, a ball valve, a dissolvable element and/or other fluid restriction device. The pressure relief valve 50 may allow the pressurized working fluid flow into the collapse chamber 70 in a controlled manner before or after the locking mechanism 90 is released to prevent sudden impact of the sleeve assembly 202. In some embodiments, the sudden impact may be desired. Then, the pressure relief valve 50 can be designed accordingly.

It should be noted that the setting tool 200 functions throughout a range of hydrostatic pressures and depending on the settings of the valve 50. For example, the hydrostatic pressure may be high enough to meet the first setting, but the second setting of the pressure relief valve 50 may not be met. In this mode of operation, the setting tool 200 may stroke without the valve 50 being closed. The pressure of the collapse chamber 70 reaches the pressure of the pressure chamber 60 and the pressure of the annulus 12 may be high enough to move the sleeve assembly 202.

In another example, the hydrostatic pressure is not high enough to meet the first setting. In this mode of operation, the setting tool 200 may stroke without the valve 50 being opened. The working fluid in the pressure chamber 60 remains isolated and merely transmits the pressure of the hydrostatic to the sleeve assembly 202.

In a variation, the locking mechanism 90 may be disposed between the fixed piston 80 and the collapse chamber sleeve 32 or some other location that constrains the movement of the sleeve assembly 202 with respect to the mandrel 20.

In another mode of operation, the floating piston 40 may shift and abut the wall 51 of the pressure sleeve 30. In that case, the hydrostatic pressure applied to the floating piston 40 is transferred to the sleeve assembly 202 and exerted on the collapse chamber 70.

In above embodiments, the hydrostatic pressure or the annulus pressure may be substituted for convenience. The hydrostatic pressure may include a pump pressure.

The foregoing description is directed to particular embodiments of the present disclosure for the purpose of illustration and explanation. It will be apparent, however, to one skilled in the art that many modifications and changes to the embodiment set forth above or embodiments of different forms are possible without departing from the scope of the disclosure. It is intended that the following claims be interpreted to embrace all such modifications and changes.

We claim:

1. An apparatus for performing a downhole operation, comprising:

a mandrel;

a sleeve telescopically engaging the mandrel;

a floating piston disposed between the sleeve and the mandrel, the floating piston having a first face subjected to a downhole hydrostatic pressure;

a valve positioned between the sleeve and the mandrel;

a pressure chamber formed between the floating piston and the valve;

a working fluid in the pressure chamber; and a variable volume fluid-tight collapse chamber formed between the valve and a sealed end of the sleeve, wherein the valve is configured to allow the working fluid from the pressure chamber into the variable volume collapse chamber if the working fluid reaches a predetermined primary pressure setting of the valve.

2. The apparatus of claim 1, wherein a pressure of the working fluid is selected to move the sleeve when the downhole hydrostatic pressure is below a predetermined value, the working fluid thereby providing a primary moving force for the sleeve.

3. The apparatus of claim 1, wherein a pressure of the working fluid is selected to allow the hydrostatic pressure to move the sleeve when the hydrostatic pressure is above a predetermined value, the hydrostatic pressure thereby providing a primary moving force for the sleeve.

4. The apparatus of claim 1, wherein a pressure of the working fluid is selected to:

move the sleeve when the downhole hydrostatic pressure is below a predetermined value, the working fluid thereby providing a primary moving force for the sleeve, and allow the hydrostatic pressure to move the sleeve when the hydrostatic pressure is above a predetermined value, the hydrostatic pressure thereby being the primary moving force for the sleeve.

5. The apparatus of claim 1, wherein a pressure of the working fluid is selected to prevent collapse of the collapse chamber by maintaining a net pressure applied to the collapse chamber below a rated collapse pressure of the sleeve.

6. The apparatus of claim 1, wherein the valve has a predetermined secondary pressure setting to close the valve.

7. The apparatus of claim 1, wherein the working fluid flows into the collapse chamber when the working fluid reaches a predetermined pressure.

8. The apparatus of claim 1, wherein the valve is at least one of: (i) a pressure relief valve, (ii) a check valve, (iii) a diaphragm, (iv) a rupture disc, (v) an electrically actuated valve, (vi) a magnetically activated valve, (vii) a poppet valve, (viii) a ball valve, (ix) a dissolvable element, or (x) other fluid restriction device.

9. The apparatus of claim 1, further comprising a retaining member limiting an axial movement of the floating piston.

10. The apparatus of claim 1, further comprising a locking mechanism that selectively couples the sleeve to the mandrel, the locking mechanism releasing the sleeve from the mandrel when actuated at a subterranean location.

11. The apparatus of claim 1, further comprising:

a fixed piston disposed between the sleeve and the mandrel and sealing an end of the collapse chamber; and a compressible gas in the collapse chamber.

12. The apparatus of claim 1, further comprising a multiple of pressure chambers and collapse chambers in series connected to the sleeve, wherein each pressure chamber of the multiple of pressure chambers is in pressure communication with an associated collapse chamber.

13. The apparatus of claim 1, further comprising a consumer disposed adjacent to the sleeve, wherein the consumer is at least one of: (i) a packer assembly, (ii) a liner hanger, (iii) a slip assembly, (iv) a cone, and (v) an expandable.

14. The apparatus of claim 1, wherein the mandrel is disposed inside the sleeve, wherein the sleeve is configured to slide between a first stroke position and a second stroke position on the mandrel, and wherein the pressure chamber is formed in an annular space between the sleeve and the mandrel.

15. The apparatus of claim 1, wherein the mandrel is disposed inside the sleeve, wherein the sleeve is configured to slide between a first stroke position and a second stroke position on the mandrel, and wherein the collapse chamber is formed in an annular space between the sleeve and the mandrel, and wherein the collapse chamber receives the working fluid as the sleeve slides to the second stroke position.

16. A method of actuating a well tool within a wellbore, comprising:

connecting a consumer to a setting tool that includes:

a mandrel;

a sleeve telescopically engaging the mandrel;

a floating piston disposed between the sleeve and the mandrel, the floating piston having a first face subjected to a downhole hydrostatic pressure;

a valve positioned between the sleeve and the mandrel;

a pressure chamber formed between the floating piston and the valve;

a working fluid in the pressure chamber; and a variable volume fluid-tight collapse chamber formed between the valve and a sealed end of the sleeve, wherein the valve is configured to allow the working fluid from the pressure chamber into the variable volume collapse chamber if the working fluid reaches a predetermined primary pressure setting of the valve; and actuating the setting tool to set the consumer.

17. The method of claim 16, wherein actuating the setting tool comprises:

unlocking a locking mechanism connecting the sleeve to the mandrel to allow the sleeve to shift in response to a pressure difference between the pressure chamber and the collapse chamber.

18. The method of claim 16, further comprising pressuring the working fluid to a selected pressure that is equal to or greater than a downhole hydrostatic pressure, the selected pressure being at least sufficient to move the sleeve.

19. The method of claim 16, further comprising pressuring the working fluid to a selected pressure that is lower than a downhole hydrostatic pressure, the selected pressure being at least sufficient to maintain a collapse pressure applied to the sleeve by maintaining a net pressure applied to the collapse chamber below a rated collapse pressure of the sleeve, and further comprising closing the valve.

* * * * *